US005697269A

United States Patent [19]

Tseng

[11] Patent Number: 5,697,269

[45] Date of Patent: Dec. 16, 1997

[54] FLEXIBLE WRENCH EXTENSION

[76] Inventor: Kuo Hwa Tseng, No. 355-1, Ruen Mei Road, Nan Mei Li, Chang Hua, Taiwan

[21] Appl. No.: 666,957

[22] Filed: Jun. 20, 1996

[51] Int. Cl.[6] ..... B25B 23/16

[52] U.S. Cl. ..... 81/177.6; 81/177.2

[58] Field of Search ..... 81/177.1, 177.2, 81/177.6

[56] References Cited

U.S. PATENT DOCUMENTS 4,876,929 10/1989 Kozak ..... 81/177.6 X

*Primary Examiner*—James G. Smith

*Attorney, Agent, or Firm*—Charles E. Baxley, Esq.

[57] ABSTRACT

A flexible wrench extension includes a housing having two barrels disposed in the end portions and having two helical springs secured between the barrels. One of the helical springs includes a circular cross section having a helical gap for engaging with the other helical spring of rectangular cross section. A driver bit and a coupler are rotatably engaged in the barrels for engaging with fastening members and a flexible wire is secured between the driver bit and the coupler for allowing the driver bit and the coupler to be rotated in concert with each other.

1 Claim, 1 Drawing Sheet

FLEXIBLE WRENCH EXTENSION

BACKGROUND OF THE INVENTION

1. Field of the Invention

The present invention relates to a wrench extension, and more particularly to a flexible wrench extension.

2. Description of the Prior Art

Typical basin wrench or socket wrench extensions comprise a solid rod configuration that may not be folded or bent such that the wrench extensions may not be used for working in a number of special conditions.

The present invention has arisen to mitigate and/or obviate the afore-described disadvantages of the conventional wrench extensions.

SUMMARY OF THE INVENTION

The primary objective of the present invention is to provide a wrench extension which is flexible for allowing the wrench extension to be engaged with shielded fastening members.

In accordance with one aspect of the invention, there is provided a flexible wrench extension comprising a housing including two ends each having a barrel provided therein, the housing including a first helical spring of circular cross section secured between the barrels, the first helical spring including a helical gap formed therein, a second helical spring of rectangular cross section engaged in the helical gap of the first helical spring so as to prevent the first helical spring from being compressed, the second helical spring including two ends secured to the barrels respectively, a driver bit and a coupler rotatably engaged in the barrels respectively for engaging with fastening members respectively, and a flexible wire secured between the driver bit and the coupler for allowing the driver bit and the coupler to be rotated in concert with each other.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
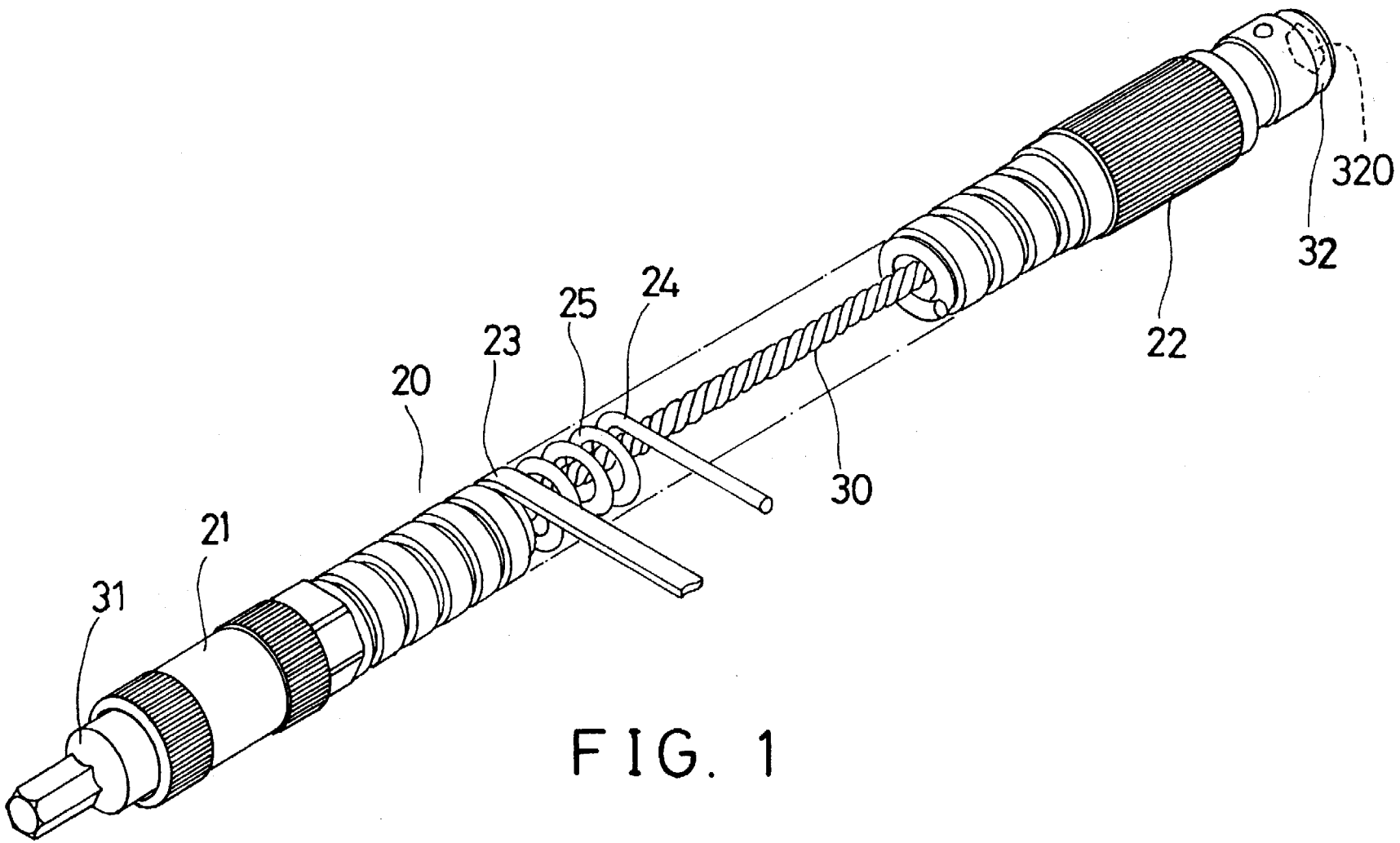
FIG. 1 is a perspective view of a flexible wrench extension in accordance with the present invention, in which a portion of the outer housing is cut off for clearly showing the interior configuration of the wrench extension.

Referring to FIG. 1, a flexible wrench extension in accordance with the present invention comprises an outer housing 20 including two barrels 21, 22 provided in the end portions and including a helical spring 24 secured between the barrels 21, 22. The user may grasp the flexible wrench extension by holding the barrels 21, 22. The helical spring

24 of circular cross section includes a helical gap 25 formed therein. The housing 20 further includes a helical spring 23 of rectangular cross section engaged in the helical gap 25 of the helical spring 24 so as to prevent the helical spring 24 from being compressed. The helical spring 23 also includes two ends secured to the barrels 21, 22 respectively. The housing 20 is thus flexible.

A driver bit 31 is rotatably engaged in the barrel 21 for engaging with fastening screws or bolts or nuts. A coupler 32 is rotatably engaged in the barrel 22 and includes an engaging hole 320 formed therein for engaging with the driving stem of the typical wrenches. A flexible wire 30 is secured between the driver bit 31 and the coupler 32 for allowing the driver bit 31 and the coupler 32 to be rotated in concert with each other.

It is to be noted that the barrels 21, 22 may be easily spring back to the aligned position as shown in FIG. 1 when only the helical spring 24 or when only the helical spring 23 is used. When the helical spring 23 of rectangular cross section is engaged in the helical gap 25 of the helical spring 24, the helical springs 24, 23 may be prevented from being compressed and the strength of the housing may be greatly increased.

Accordingly, the flexible wrench extension in accordance with the present invention includes a flexible configuration for allowing the wrench extension to be engaged with shielded fastening members and includes two helical springs engaged with each other so as to increase the strength of the housing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flexible wrench extension comprising:

a housing including two ends each having a barrel provided therein, said housing including a first helical spring of circular cross section secured between said barrels, said first helical spring including a helical gap formed therein, a second helical spring of rectangular cross section engaged in said helical gap of said first helical spring so as to prevent said first helical spring from being compressed, said second helical spring including two ends secured to said barrels respectively, a driver bit and a coupler rotatably engaged in said barrels respectively for engaging with fastening members respectively, and a flexible wire secured between said driver bit and said coupler for allowing said driver bit and said coupler to be rotated in concert with each other.

* * * * *